US008028485B2

(12) United States Patent
Pfeffer et al.

(10) Patent No.: US 8,028,485 B2
(45) Date of Patent: Oct. 4, 2011

(54) MODULE HAVING DISPLACEMENT BODIES FOR THE PRODUCTION OF CONCRETE ELEMENTS

(75) Inventors: Karsten Pfeffer, Wiesbaden (DE); Dejan Krecov, Glis (CH); Georg Miedzik, Hittnau (CH); Michael Stuecklin, Zürich (CH)

(73) Assignee: Cobiax Technologies AG, Zug (CH)

( * ) Notice: Subject to any disclaimer, the term of this patent is extended or adjusted under 35 U.S.C. 154(b) by 265 days.

(21) Appl. No.: 12/167,625

(22) Filed: Jul. 3, 2008

(65) Prior Publication Data

US 2009/0165420 A1 Jul. 2, 2009

(30) Foreign Application Priority Data

Dec. 28, 2007 (EP) ..... 07405371

(51) Int. Cl.
*E04C 5/20* (2006.01)

(52) U.S. Cl. ..... 52/576; 52/577

(58) Field of Classification Search ..... 52/576, 52/577, 323, 325
See application file for complete search history.

(56) References Cited

U.S. PATENT DOCUMENTS

| | | | | | |
|---|---|---|---|---|---|
| 1,160,384 | A * | 11/1915 | Crane | 52/577 |
| 1,625,900 | A * | 4/1927 | Lally | 52/323 |
| 3,188,088 | A * | 6/1965 | Gatke | 473/587 |
| 3,800,833 | A * | 4/1974 | Young | 138/89 |
| 3,889,308 | A * | 6/1975 | Persson | 441/56 |
| 5,396,747 | A * | 3/1995 | Breuning | 52/577 |
| 5,797,230 | A * | 8/1998 | Lassen | 52/323 |
| 7,540,121 | B2 * | 6/2009 | Haeussler | 52/323 |

FOREIGN PATENT DOCUMENTS

| | | | | |
|---|---|---|---|---|
| DE | 202006002540 U1 | | 9/2006 | |
| JP | 09-250196 | * | 9/1997 | 52/576 |
| JP | 3082676 | * | 10/2001 | 52/576 |
| WO | 2005080704 A1 | | 9/2005 | |

OTHER PUBLICATIONS

"Heavy plastic compounds weigh in against metal. (Keeping Up With: Material)" article, Plastic Technology magazine, Feb. 1, 2007.*

* cited by examiner

*Primary Examiner* — Michael Safavi
(74) *Attorney, Agent, or Firm* — Pearne & Gordon LLP

(57) ABSTRACT

Module (1) for the production of concrete elements, particularly of concrete semi-finished products or of relatively "thin" in-situ concrete surfaces. The modules includes a plurality of displacement bodies (5, 5', 5", 5''') able to be inserted and arranged adjacent to each other in a longitudinal direction. The plurality of displacement bodies (5, 5', 5", 5''') is arranged respectively undetachably in a latticework (2) of bars (3, 3', 4, 4', 4"). The displacement body (5, 5', 5", 5''') is formed as a substantially oblate rotation ellipsoid with two at least slightly flattened pole sides (7, 7', 8, 8').

12 Claims, 5 Drawing Sheets

MODULE HAVING DISPLACEMENT BODIES FOR THE PRODUCTION OF CONCRETE ELEMENTS

BACKGROUND OF THE INVENTION

1. Field of Invention

The invention relates to a module for the production of concrete elements, particularly of concrete semi-finished products or of concrete surfaces, and a displacement body for use in such a module according.

The invention concerns in particular a module for the production of concrete elements, in particular of concrete semi-finished products or of relatively "thin" concrete surfaces, with a plurality of displacement bodies which are able to be inserted, arranged adjacent to each other in a longitudinal direction, in which the plurality of displacement bodies arranged adjacent to each other is arranged respectively undetachably in a latticework of bars.

2. Description of Related Art

Such modules are known from the prior art; they are used principally in the production of relatively thick concrete surfaces.

Such a module is known for example from WO 2005/080704-A1. In this module, the latticework has a base side running in the longitudinal direction and two partial sides adjoining the base side and arranged obliquely with respect to the base side, but likewise running in the longitudinal direction. The latticework which is used has a channel-like form with a wide channel base and a narrow channel opening. The displacement bodies arranged in the latticework are plastic balls.

A disadvantage of the type of construction according to WO 2005/080704-A1 consists in that with greater manufacturing tolerances of the upper lattice bar spacings, the plastic balls partially protrude to a different extent upwards out from the latticework, which has the result that the required covering values (layer thickness of the concrete over the balls) are possibly not able to be kept. In addition, there is a risk of damage for the displacement bodies.

A further such module is known from DE 202006002540 U1. In this module, also, the latticework has a channel-like form, but with a narrow channel base and a wide channel opening. The displacement bodies arranged in the latticework are likewise plastic balls. In this type of construction of the latticework, the risk of damage for the displacement bodies is considerably reduced and the covering values can be kept more reliably.

However, a disadvantage both in WO 2005/080704-A1 and also in DE 202006002540 U1 is that for thin concrete surfaces the structure of the module can not be simply reduced in size as desired. This is because the manufacturing costs of the modules are greatly increased by the increasingly required quantity of balls per unit of area. As the wire diameter for the latticework generally also can not be reduced for reasons of stability, a considerable increase in material can also occur here even for this reason. In addition the risk exists that the ball spacings become too small with respect to the current grain size of the concrete, which then results in that concrete-free "nests" can occur in the concrete surface which is to be finished, because the concrete can not distribute itself well. Furthermore, the compacting of the concrete by means of so-called vibrating needles proves to be difficult owing to the unfavourable accessibility. The simple reduction in size of all components therefore comes up against certain limits very quickly.

In the older prior art, there are various solutions with non-spherical and frequently rectangular displacement bodies, which from their static generic form are to be regarded as rib surfaces. However, these displacement bodies are generally not embedded in a latticework and therefore are also not protected against floating; i.e. additional steps must be taken for this purpose. In addition, in fact in the case of rectangular displacement members the force distribution lines within the stressed concrete surface lie so unfavourably that large intermediate zones are produced, in which the stress concentrations (on loading of the concrete surface) become so high that the risk of local failure exists in the concrete mass surrounding the displacement bodies. This disadvantage is eliminated for example by the additional introduction of reinforcing steel in these intermediate zones, which, however, leads to an additional aggravating condition in the construction sequence and to an increased requirement for material. In addition, the size of the area of the lower plane of these displacement bodies can lead to the guaranteeing of the underflowing of the concrete only being able to be ensured with specific concrete compositions and with an additional processing expenditure.

The problem therefore exists that in the case of "thin" concrete surfaces, such as for instance short-span surfaces in house construction or in skyscrapers, neither the module concept according to WO 2005/080704-A1 or DE 202006002540 U1 nor the previously usual concept with rectangular or flat displacement bodies can be readily undertaken. In the former case (i.e. with spherical displacement bodies), the mere reduction in size leads to the stated problems with regard to cost and handling, whereas in the latter case (i.e. with, for example, rectangular displacement bodies), an unnecessarily large extent of structural strength of the concrete surface is provided.

It is therefore an object of the invention to indicate an improved module for the production of concrete elements, in particular of concrete semi-finished products or of "thin" in-situ concrete surfaces and a displacement body for use in such a module, by which the disadvantages known from the prior art are circumvented.

BRIEF SUMMARY OF THE INVENTION

This problem is solved by the features of as claimed.

The content of the solution is that the displacement body is constructed as a substantially oblate rotation ellipsoid with two at least slightly flattened pole sides.

By the oblate rotation ellipsoidal shape, the "inactive" parts of the concrete surrounding the displacement body are kept as small as possible. "Inactive" means here that the characteristics of the concrete are such that with sharp-edged geometries stress concentrations can occur at which the material fails locally and thus becomes "inactive". It can therefore be regarded as a matter of course to construct all transitions, edges or suchlike formed on the displacement body so as to be at least slightly rounded and therefore to circumvent the occurrence of sharp-edged geometries. Compared with systems which must be regarded from their static generic form as a rib surface, the invention described here leads in the installed state to a concrete support structure consisting of a lower and an upper plate, connected with concrete columns which are haunched on circumferentially above and below, with a high stability owing to the geometric construction thereof. The development of the displacement body therefore allows the concrete surface which is equipped with these displacement bodies to be able to continue to be regarded, from its static generic form, as a flat surface or as a plate supporting structure. This is advantageous for dimensioning with respect to the expedient use of reinforcing steel. On the other hand however, with the substantially oblate development, taking economic factors into account, the number of displacement bodies can be successfully reduced to a minimum of displacement bodies per unit of area and nevertheless the achieved displacement volume can be kept in a favourable range for commercial application. The displacement body can therefore displace a maximum of concrete, owing to its shape or quality, whilst maintaining an expedient rigidity, loading capacity and bearing strength.

One embodiment makes provision that the displacement body can be formed as a hollow body. However, it is also conceivable to produce the displacement body as a solid body, of a correspondingly "light" material, such as polystyrene for example.

Preferably, but in no way compulsorily, the displacement body can be made from plastic. However, basically any other material is conceivable as long as it is guaranteed that the material which is used is basically lighter than concrete or is formed as a "light body" compared therewith.

In addition, it has proved to be particularly advantageous in a displacement body with an external diameter D and with a height H to maintain a D/H ratio with the value of 2.25 or at least not to allow this to be exceeded. It has in fact been found that the static effect mechanism (i.e. the local load transfer) compared with the spherical form of the displacement bodies under these conditions still develops a comparable effect. The strength characteristics of a concrete surface with displacement bodies according to the invention are therefore comparable or even more advantageous with respect to the strength characteristics of a concrete surface with, for example, spherical displacement bodies. The horizontal diameter of the displacement body is therefore to be selected so that an underflowing of the concrete under the lower plane of the displacement body is guaranteed in every case.

A next embodiment makes provision to construct the displacement body in one piece. This has the advantage that the displacement body can have particularly good handling characteristics.

However, it is also conceivable to produce the displacement body from at least two partial elements which are able to be assembled, particularly half shells. The advantages of this embodiment lie in the fact that in the case of a possible damage to one of the partial elements, the displacement body does not have to be completely exchanged or removed, but rather only the damaged partial element can be replaced. In addition, compared with the displacement bodies, such half shells can be transported in large numbers with the available loading volume remaining the same. The partial elements can be connected or fixed to each other here in any conceivable manner.

In addition, it is conceivable that at least on the two pole sides, a substantially round, flat and sunken area can be present, which is surrounded by a type of annular wall. The depression allows an enlarged concrete casing of the reinforcement lattices situated above and below the two pole sides directly over the hollow bodies, which leads to optimized circumferential stress states relating to the compound effect of the reinforcement. The annular wall can be interrupted here by at least one indentation. The indentations serve to eliminate any air reservoirs present above or below the displacement body, by the air being able to escape via the indentations during the concrete casting process and therefore a complete support or filling of the module or of the displacement bodies can occur.

Preferably, but in no way compulsorily, several, in particular three, indentations can be provided on each pole side.

A preferred embodiment makes provision that in the sunken areas in the region of the indentation, at least one spacer cam is provided. This spacer cam is intended to prevent metal parts, for example bars of the latticework, from arriving into the indentation, finally closing the latter and consequently preventing the outlet of air, during the installation of the module or during the transfer of the module.

A further embodiment makes provision that the displacement body has at least one vertically-running passage opening, with the latter opening out on both pole sides. This through-bore can serve, for example, to guarantee an improved ventilation behaviour or else to be used as an additional fixing possibility. Basically it is conceivable, depending on the embodiment of the displacement body, to construct the passage opening as a bore, recess or else as a hollow tube or suchlike.

The passage opening preferably runs substantially parallel to the vertical rotation axis of the displacement body.

BRIEF DESCRIPTION OF THE DRAWINGS

The invention is explained in further detail below with the aid of an example embodiment.

In the drawings.

DETAILED DESCRIPTION OF THE INVENTION

Figure 1:
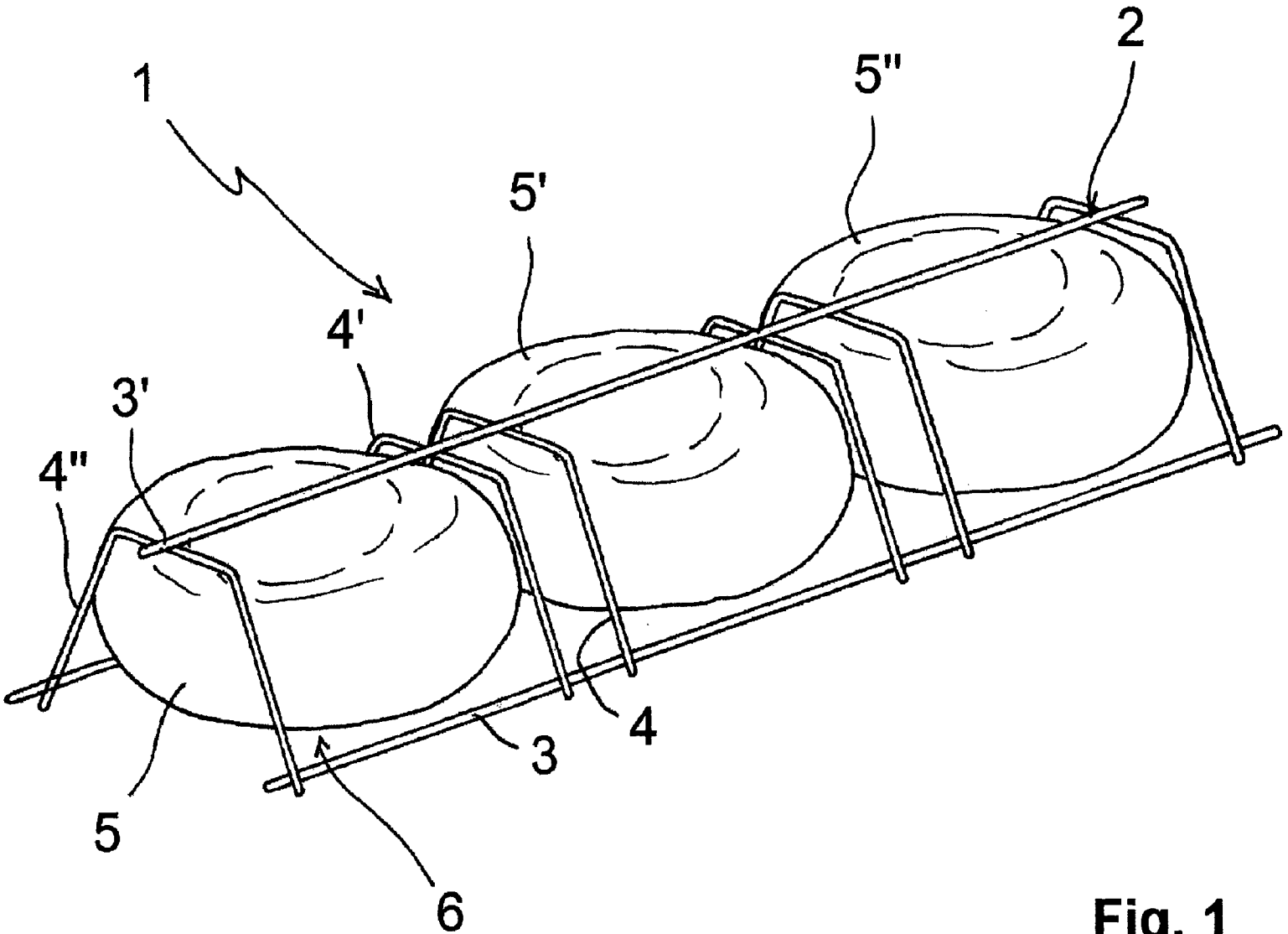
FIG. 1 shows a module according to the invention for the production of concrete elements in a three-dimensional view.

FIG. 1 shows a module 1 for the production of concrete elements in a three-dimensional view. The module 1 consists of a latticework 2 formed from several bars, in which individual bars 3 are constructed so as to be straight, and other bars 4 are constructed so as to be substantially u- or trough-shaped. The bars 3, 4 are connected with each other and, together, form the latticework 2 receiving the displacement bodies 5. The bars 4 are arranged here on the bars 3 so that respectively two adjacent bars 4 define a receiving space 6 each for one displacement body 5. The receiving space 6 is formed so that it surrounds or fixes the displacement body 5 such that a driving up or slipping of the displacement body 5 inside the receiving space 6 can be substantially avoided. The latticework can basically extend over almost any desired size. The receiving space 6 is formed here substantially by the bar 3' arranged above the displacement body 5 and the bars 4' and 4" arranged perpendicularly thereto. In the case of the latticework 2 shown here, three displacement bodies 5, 5' and 5" are arranged adjacent to each other in the longitudinal direction. The displacement bodies 5, 5' and 5" shown here are merely illustrated diagrammatically for the basic illustration of the module 1 and are described in further detail in FIG. 2.

Figure 2:
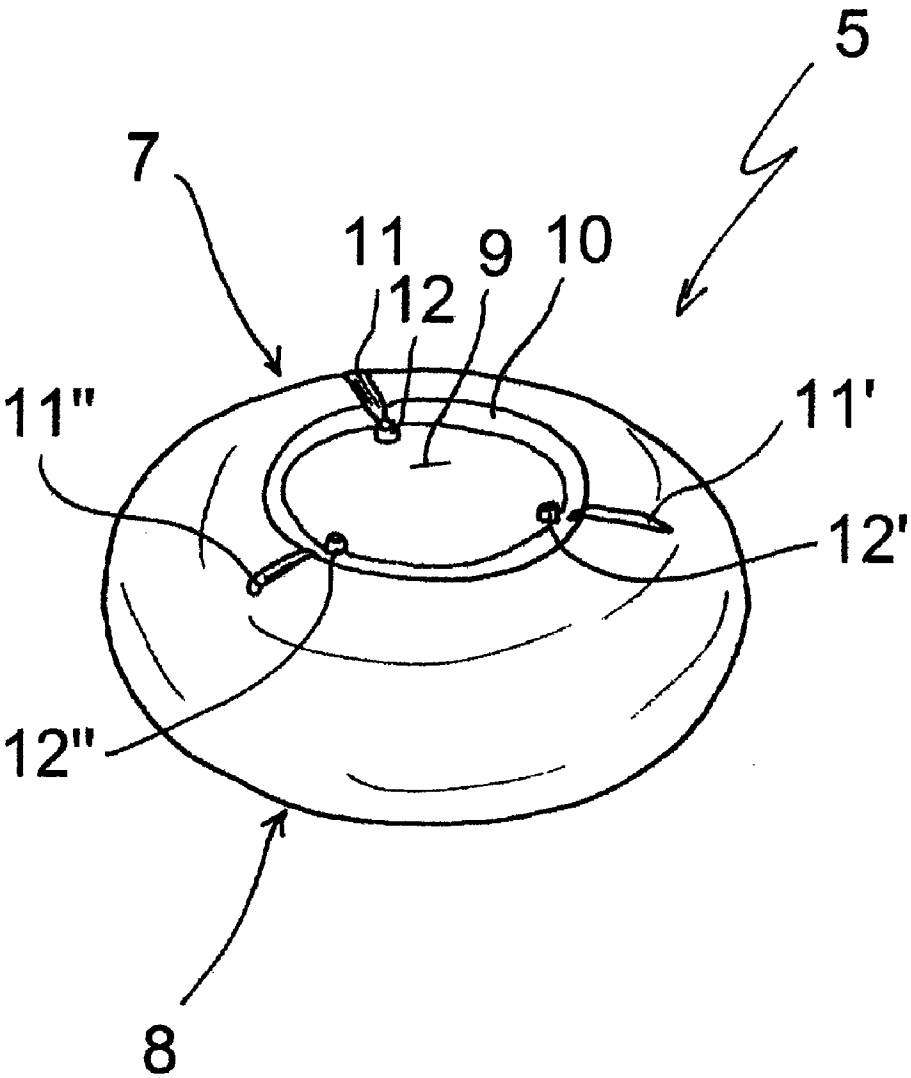
FIG. 2 shows a displacement body for a module according to FIG. 1 in three-dimensional view.

FIG. 2 shows the displacement body 5 according to FIG. 1 in a three-dimensional, detailed view. The displacement body 5 is formed as a substantially oblate rotation ellipsoid with two flattened pole sides 7 and 8. On pole side 7 and also on pole side 8 (not illustrated), a substantially round, flat and sunken area 9 is present, which is surrounded by an annular wall 10. The annular wall 10 is interrupted here by three indentations 11, 11' and 11".

In addition, on the sunken area 9 in the region of the indentations 11, 11' and 11", spacer cams 12, 12' and 12" are provided. These spacer cams 12, 12', 12" are formed so as to be at least as high as the annular wall 10.

Figure 3:
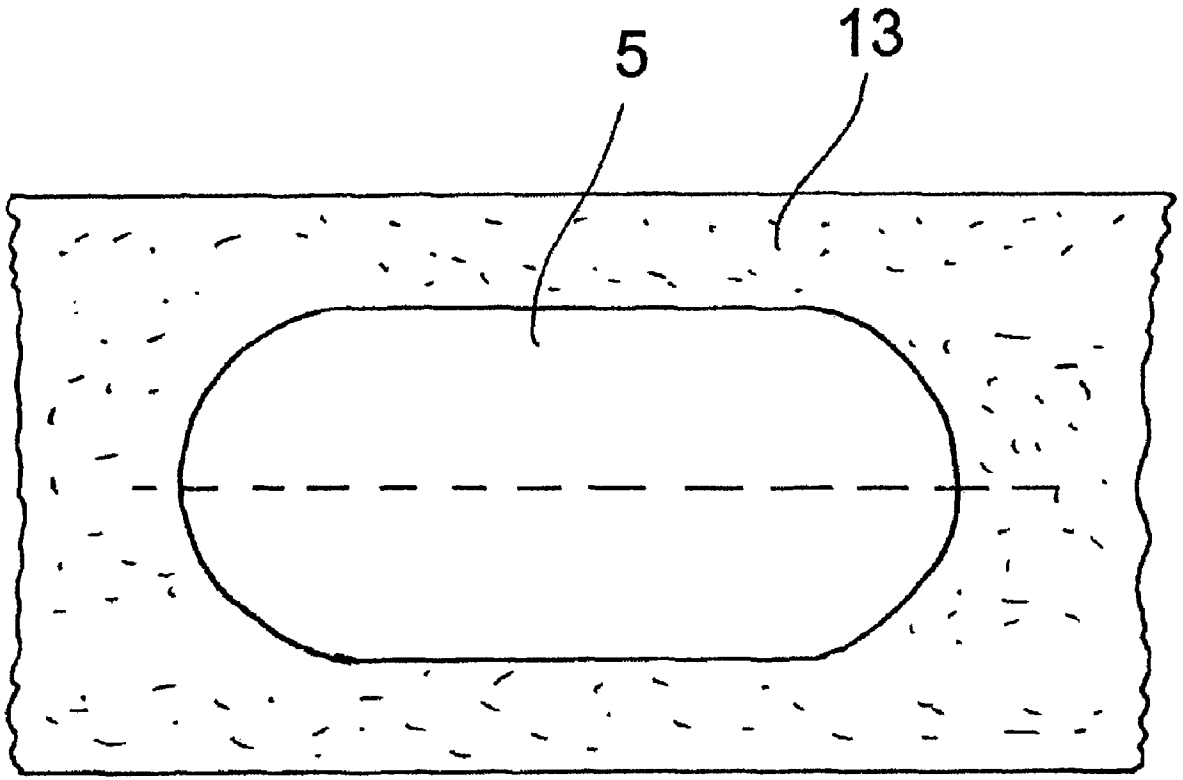
FIG. 3 shows a diagrammatic illustration of a displacement body in the mounted state in a concrete bed.

FIG. 3 shows a diagrammatic illustration of a displacement body 5 in the mounted state in a concrete surface 13. A latticework is present surrounding the displacement body 5, but is not illustrated here.

Figure 4:
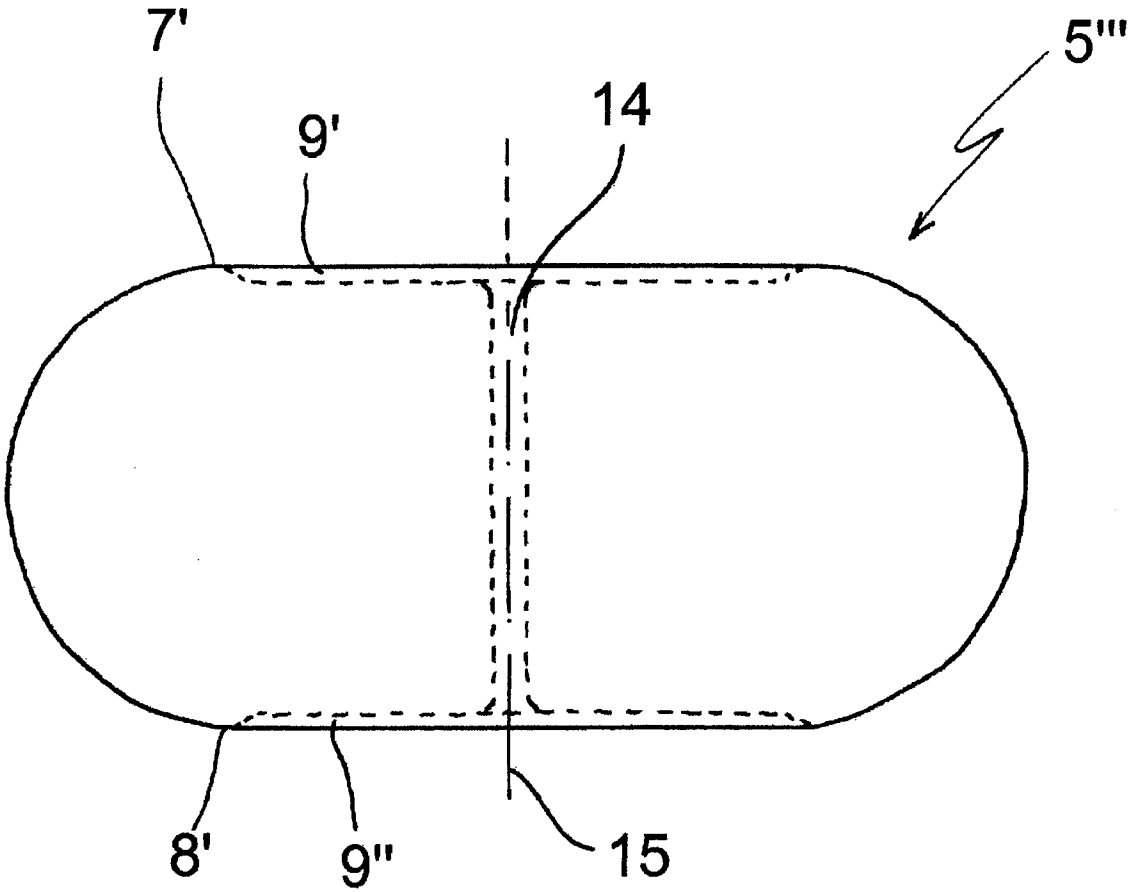
FIG. 4 shows an alternative embodiment of a displacement body according to the invention.

FIG. 4 shows an alternative embodiment of a displacement body 5'''. The displacement body 5''' has a vertically-running passage opening 14 which runs substantially parallel to the rotation axis 15 of the displacement body 5'''. Areas 9' and 9", which are arranged in a sunken manner, can likewise be seen on each pole side 7' and 8'.

Figure 5:
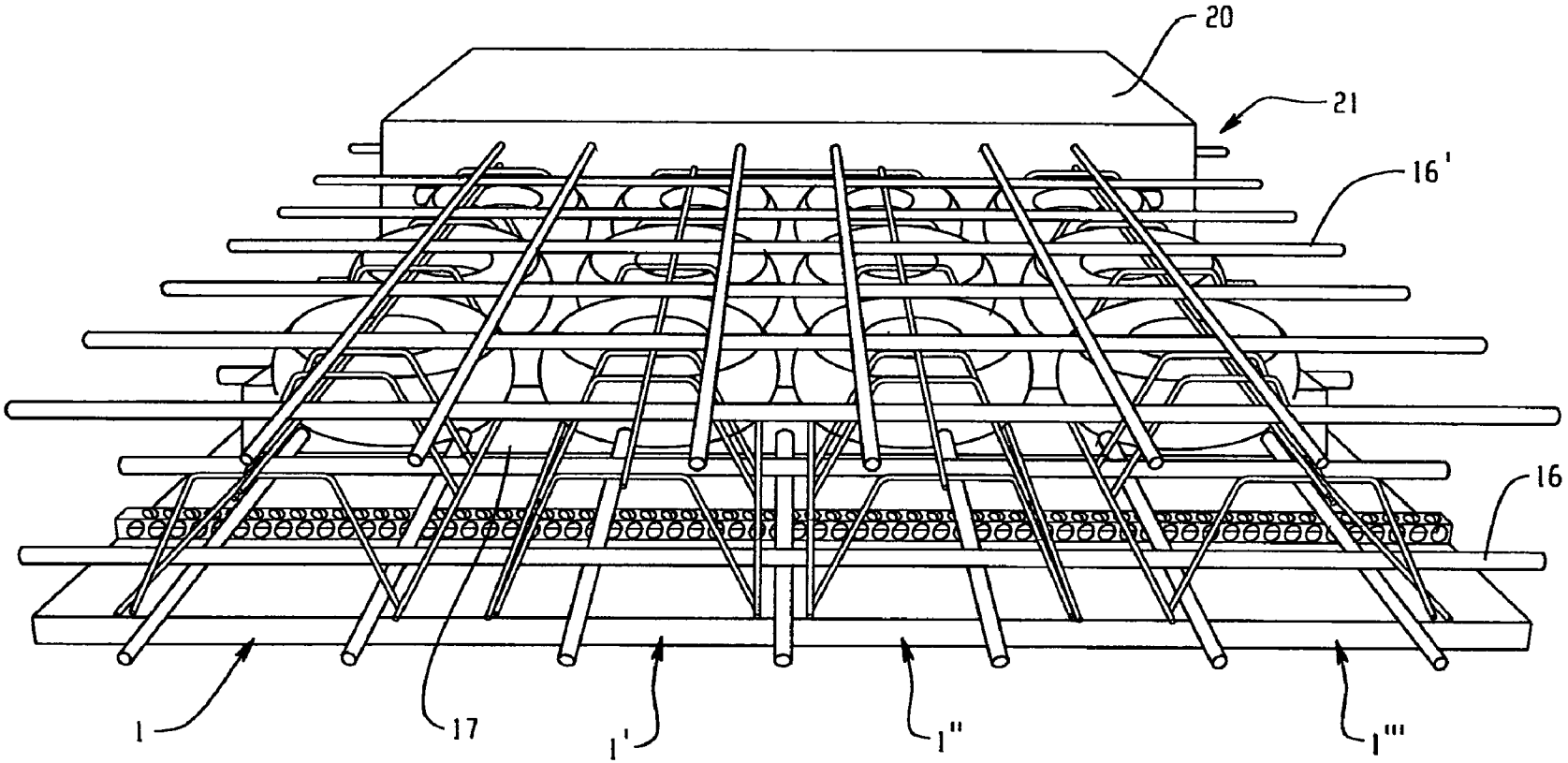
FIG. 5 shows a diagrammatic illustration of several modules in mounted state, which corresponds in particular to the in-situ concrete method or the industrial pre-fabrication in the concrete finished part works.

FIG. 5 shows a diagrammatic illustration of several modules 1, 1', 1", 1''' in partially mounted state. The modules 1, 1', 1", 1''' lie on reinforcement supports 16. The reinforcement supports 16 are in turn embedded in a lower concrete layer 17. It is irrelevant here in which operating sequence with respect to the modules 1, 1', 1", 1''' and the reinforcement supports 16 the first concrete layer is introduced. For example, the construction consisting of reinforcement supports 16, the modules 1, 1', 1", 1''' and the reinforcement supports 16' lying thereabove can already be made available before the concreting, or only gradually with the concreting process. An upper, second concrete layer 20 encases in a rear, already finished region 21 of the mounting plane, the modules 1, 1', 1", 1''', on the upper region of which a second reinforcement support 16' is arranged.

The size of the modules or the size of the displacement bodies is in any case to be determined in such a way that the required covering values (layer thickness of the concrete above or below the displacement body) are maintained.

What is claimed is:

1. A module (1) for the production of concrete elements, the module comprising:

a latticework (2) of bars (3, 3', 4, 4', 4"), in which a plurality of displacement bodies (5, 5', 5", 5''') is undetachably arranged adjacent to each other in a longitudinal direction, wherein at least one displacement body (5, 5', 5", 5''') of the plurality of displacement bodies is formed as a substantially oblate rotation ellipsoid with two at least slightly flattened pole sides (7, 7', 8, 8').

2. The module according to claim 1, wherein the at least one displacement body (5, 5', 5", 5''') is formed as a hollow body.

3. The module according to claim 1, wherein the at least one displacement body (5, 5', 5", 5''') is formed as a solid body.

4. The module according to claim 1, wherein the at least one displacement body (5, 5', 5", 5''') consists of plastic.

5. The module according to claim 1, wherein the at least one displacement body (5, 5', 5", 5''') has an external diameter D and a height H, with the D/H ratio not exceeding the value of 2.25.

6. The module according to claim 1, wherein the at least one displacement body (5, 5', 5", 5''') is formed in one part.

7. The module according to claim 1, wherein the at least one displacement body (5, 5', 5", 5''') consists of two half shells which are able to be assembled.

8. The module according to claim 1, wherein on each pole side (7, 7', 8, 8') a substantially round, flat and sunken area (9, 9', 9") is present which is surrounded by an annular wall (10).

9. The module according to claim 8, wherein the annular wall (10) is interrupted by at least one indentation (11, 11', 11").

10. The module according to claim 9, wherein in the sunken areas (9, 9', 9") and in a position aligned with the at least one indentation (11, 11', 11") at least one spacer cam (12, 12', 12") is arranged.

11. The module according to claim 8, wherein the at least one displacement body (5, 5', 5", 5''') has at least one vertically-running passage opening (14), with the passage opening (14) opening out on both pole sides (7, 7', 8, 8').

12. The module according to claim 11, wherein the passage opening (14) is formed as a through-bore or hollow tube and runs substantially parallel to an axis of rotation (15) of the displacement body (5, 5', 5", 5''').

* * * * *

UNITED STATES PATENT AND TRADEMARK OFFICE

CERTIFICATE OF CORRECTION

PATENT NO. : 8,028,485 B2
APPLICATION NO. : 12/167625
DATED : October 4, 2011
INVENTOR(S) : Karsten Pfeffer et al.

It is certified that error appears in the above-identified patent and that said Letters Patent is hereby corrected as shown below:

In the Specification, column 1, line 11, please remove the word "according"

Signed and Sealed this
Twenty-seventh Day of December, 2011

David J. Kappos

David J. Kappos
*Director of the United States Patent and Trademark Office*